US005902448A

United States Patent [19]

Stettner

[11] Patent Number: 5,902,448

[45] **Date of Patent: *May 11, 1999**

[54] METHOD AND DEVICE FOR PREPARING THE BEGINNING OF A PAPER WEB FEED ROLL FOR CHANGING ROLLS IN MOTION

[75] Inventor: Gerd Erich Stettner, Stadtlauringen, Germany

[73] Assignee: Koenig & Bauer-Albert Aktiengesellschaft, Wurzburg, Germany

[ * ] Notice: This patent is subject to a terminal disclaimer.

[21] Appl. No.: 08/765,449

[22] PCT Filed: Jul. 15, 1995

[86] PCT No.: PCT/DE95/00936

§ 371 Date: Jan. 21, 1997

§ 102(e) Date: Jan. 21, 1997

[87] PCT Pub. No.: WO96/02451

PCT Pub. Date: Feb. 1, 1996

[30] Foreign Application Priority Data

Jul. 20, 1994 [DE] Germany ..... 44 25 663

[51] Int. Cl.[6] ..... B32B 31/00; B65H 19/18

[52] U.S. Cl. ..... 156/510; 156/502; 156/504; 156/157; 242/553; 242/554.2; 242/555.3; 242/556; 242/580; 242/583

[58] Field of Search ..... 156/157, 159, 156/256, 267, 502, 504, 510, 512; 242/551, 553, 554.2, 555.3, 556, 580, 583, 160.1

[56] References Cited

U.S. PATENT DOCUMENTS

| | | | |
|---|---|---|---|
| 2,104,774 | 1/1938 | Scott | 242/58 |
| 2,320,658 | 6/1943 | Roesen | 242/58 |
| 4,543,152 | 9/1985 | Nozaka | 156/510 |
| 4,685,392 | 8/1987 | Watanabe | 101/226 |
| 4,802,632 | 2/1989 | Fukuda et al. | 242/58.5 |
| 4,812,198 | 3/1989 | Fuke et al. | 242/553 |
| 5,322,230 | 6/1994 | Dylla et al. | 242/58.5 |
| 5,783,029 | 7/1998 | Stettner et al. | 156/510 |

FOREIGN PATENT DOCUMENTS

| | | |
|---|---|---|
| 0 181 280 | 5/1986 | European Pat. Off. . |
| 0 166 884 | 3/1988 | European Pat. Off. . |
| 0 547 500 | 6/1993 | European Pat. Off. . |
| 39 18 552 | 12/1990 | Germany . |
| 38 11 138 | 2/1992 | Germany . |

OTHER PUBLICATIONS

Patent Abstracts of Japan; JP 63127961; May 1988; vol. 12, No. 376.

Patent Abstracts of Japan; JP 63147754; Jun. 1988; vol. 12, No. 404.

*Paper, Film & Foil*; "Continuous Splicing Techniques"; D. Smith; Nov. 1987.

*Primary Examiner*—David A. Simmons
*Assistant Examiner*—Linda L Gray
*Attorney, Agent, or Firm*—Jones, Tullar & Cooper, P.C.

[57] ABSTRACT

A leading edge of a paper web on a paper web feed roll is prepared for use in a flying web splice. The paper web feed roll is supported adjacent a carriage which is movable generally parallel to an axis of rotation of the paper web feed roll. The carriage carries a paper web leading edge cutter, and adhesive tab dispensing device, an adhesive tape application device and a web corner cutting device. The free end of the paper web is end cut, has adhesive tabs applied to it, is provided with a double sided adhesive splice tape and has lateral edge cuts formed in one pass of the carriage across the face of the paper web feed roll.

24 Claims, 5 Drawing Sheets

METHOD AND DEVICE FOR PREPARING THE BEGINNING OF A PAPER WEB FEED ROLL FOR CHANGING ROLLS IN MOTION

FIELD OF THE INVENTION

The invention relates to a method and a device for preparing the start of a paper web feed roll for a flying roll change.

DESCRIPTION OF THE PRIOR ART

U.S. Pat. No. 4,802,632 describes a method for producing the start of a paper web feed roll placed on a shaft and for preparing this start for a flying roll change.

Two displaceable transverse cutting devices are provided for executing this method. A first transverse cutting device creates a free end of the paper web roll wherein several layers at the outside of the paper feed roll are cut through. The free end of the paper feed roll created in this manner is supplied to a holding device and is temporarily held therein. In this state, a short cut and a cutout are made in the free end by means of a second transverse cutting device.

A single tab is set by means of a device for applying tabs, which through the cutout connects the start of the paper feed roll with the paper layer underneath it. Finally, a trapezoidal start is cut out of the free end of the paper feed roll by means of a third transverse cutting device. After applying a double-sided adhesive tape of a liquid adhesive along the start of the paper feed roll, the preparation of the start of the paper feed roll is completed.

EP-A-0 181 280 discloses a work carriage, on which a transverse cutting device and an adhesive tape application device are arranged.

A device for preparing the start of a paper web feed roll, by means of which a top layer of the paper web feed roll is cut open in a axis-parallel direction by a cutter and the paper web start is cut in the shape of a letter V on a table by means of cutting tools operating in the longitudinal and transverse directions is known from U.S. Pat. No. 4,685,392. In the course of preparing the paper web start in a triangular shape by means of the cutting tools, adhesive paster tabs which have adhesive on both sides are simultaneously applied. An adhesive tab for fixing the paper web start on the second layer of the paper web feed roll is applied to the center of the V-shaped paper web tip by means of an adhesive tab application device separately disposed underneath the table.

It is a limitation of this prior art device that several devices which operate independently of each other are required for preparing a start of a paper web roll for a flying roll change.

SUMMARY OF THE INVENTION

It is the object of the present invention to provide a compact, versatile device for preparing the start of a paper web feed roll, as well as a corresponding method.

This object is attained in accordance with the invention by preparing the start of a paper web feed roll for use in a flying web change by using a displaceable transverse cutting device. This cutting device creates a free end of the cutting web. Adhesive tabs are then applied to the free end to adhere this start to the second layer on the paper web feed roll. A free end of the web, which is hanging down from the feed roll, is inserted into a holding device and is held in such a way that the free end at least covers a cutting groove situated in a counter cutting strip. A transverse cutting device cuts the paper web along the cutting groove. Subsequently, spaced apart, one sided glued adhesive tabs are applied in a direction parallel to the axis of rotation of the paper web feed roll. These tabs are applied by a displaceable adhesive tab dispensing device in such a way that a second part of each tab projects past the cut edge of the paper web start. Then a double sided adhesive tape is applied by its own dispensing device in the vicinity of and parallel with the paper web cut edge. After this has been accomplished, the start of the paper web is rolled back on the paper web feed device and finally the second parts of the adhesive tabs are pressed onto the second layer of the paper web feed roll and adhere to it.

The advantages of the invention in particular consist in that transverse cutting as well as the application of adhesive tabs with adhesive on both sides is preferably performed in the course of a single movement of a work carriage performed in an axis-parallel direction. Thus the technical outlay as well as the expenditure of time are greatly reduced when preparing a paper web feed roller placed on a shaft for a flying roll change. Because of its low space requirement, the device in accordance with the present invention can also be arranged in a decentralized manner, i.e. at the roll changer of each rotary printing press. It is possible in this case to apply any arbitrary number of adhesive tabs at the start of the paper web over the entire width of the paper web, so that an assurance against premature loosening of the paper web start is provided when the paper web feed roll is accelerated. The adhesive tip can be formed in different geometric shapes.

BRIEF DESCRIPTION OF THE DRAWINGS

The method and device for preparing the beginning of a paper web feed roll for changing rolls in motion, in accordance with the present invention will be represented below in more detail by means of an exemplary embodiment. The associated drawings show in FIG. 1, a total view of the device in accordance with the present invention on the lateral frames of a roll changer in a perspective schematic representation, FIG. 2, a section taken along line II—II in FIG. 1, FIG. 3, a view taken in the direction indicated by the arrow D in FIG. 2, but without showing the work carriage, FIG. 4, a top view of the work carriage, FIG. 5, a portion from FIG. 4 with the enlarged representation of the adhesive tab dispenser.

DETAILED DESCRIPTION OF THE PREFERRED EMBODIMENT

Figure 1:
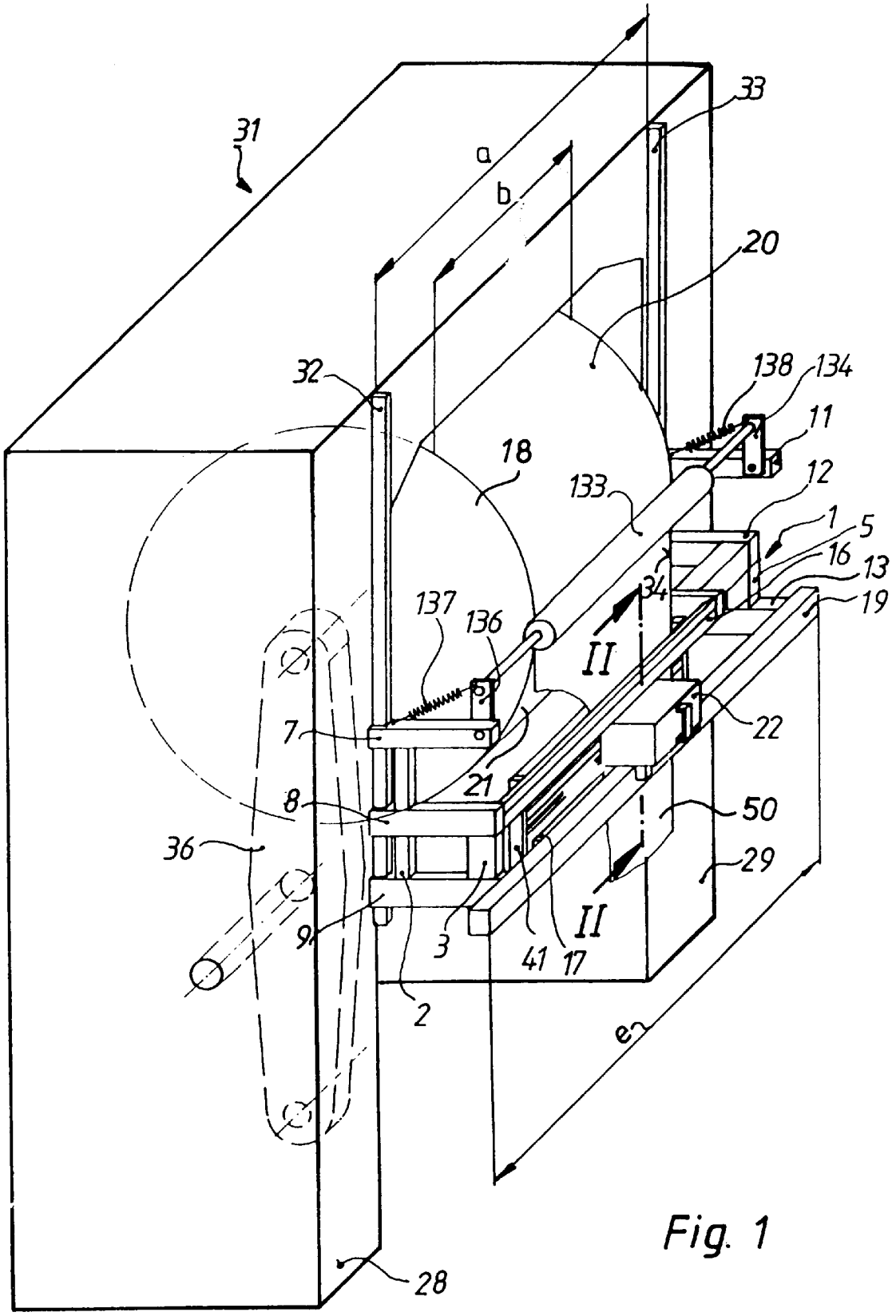
Figure 2:
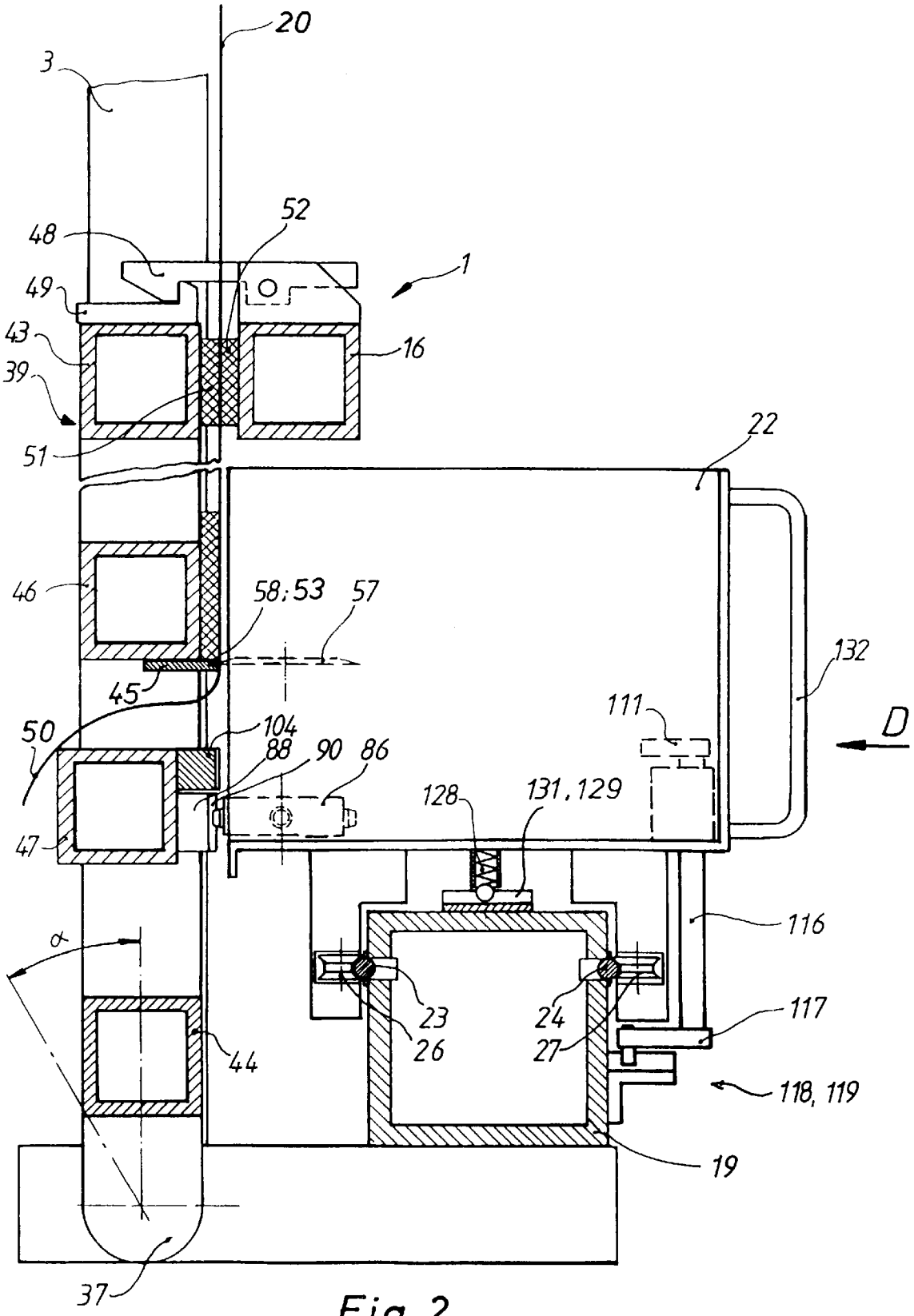

A frame, identified by 1 as a whole, consists of two pairs of perpendicularly arranged supports 2, 3; 4, 5, which are respectively connected with each other in pairs by means of struts 7, 8, 9; 11, 12, 13, as seen in FIG. 1. The pairs of supports 2, 3 and 4, 5 are disposed at a distance "a" from each other and connected with each other by cross bars 16, 17 in such a way that this corresponds at least to the width "b" of a paper web feed roll 18. A guide rail 19 of a length "e" is disposed parallel with the lower cross bar 17 for receiving a work carriage 22, which can be displaced in the axis-parallel direction of the paper web feed roll 18. The length "e" of the guide rail 19 is of such a dimension, that the work carriage 22 can move on both sides past the width "b" of the paper web feed roll 18 to be processed. The guide rail 19 has guides 23, 24 on both sides, as seen in FIG. 2, with which guide wheels 26, 27 of the work carriage 22 are in frictional and interconnected contact. As the main carriage, the frame 1 can be moved up and down in the vertical direction along the guide rails 32, 33, for example, on the fronts of a lateral frame 28, 29 of a roll changer 31 as shown in FIG. 1. This can be performed manually, for example in that cable pulls and reversing rollers and counterweights, not shown, are disposed on the roll changer 31 for compensating the weight of the main carriage which is displaceable in the vertical direction, or by means of providing a drive element, for example a motor-driven pinion gear and toothed rack. The supports 2 to 5, the struts 7 to 9 and 11 to 13, the cross bars 16, 17 and the guide rails 19, 32, 33 can be made of a known profiled material.

In accordance with a further preferred embodiment, it is possible to dispose the frame 1 not on a roll changer 31, but separately on a carriage, not shown, with a lifting mechanism for lifting the frame 1, wherein the carriage can be movably disposed on rails (see DE 39 18 552 A1, FIG. 1). Because of its mobility, it is therefore possible to approach several roll changers with the device in accordance with the present invention in order to prepare the start of paper web feed rolls 18, for example placed on shafts on support arms 36, for a flying roll change.

In accordance with another preferred embodiment, it is possible to arrange the frame 1 in fixed side frames, for example, and to equip the side frames with pivot arms for receiving and rotatable seating of the paper web feed rolls 18. In this case known conveying devices for bringing and taking away the paper web feed rolls 18 are provided.

Figure 3:
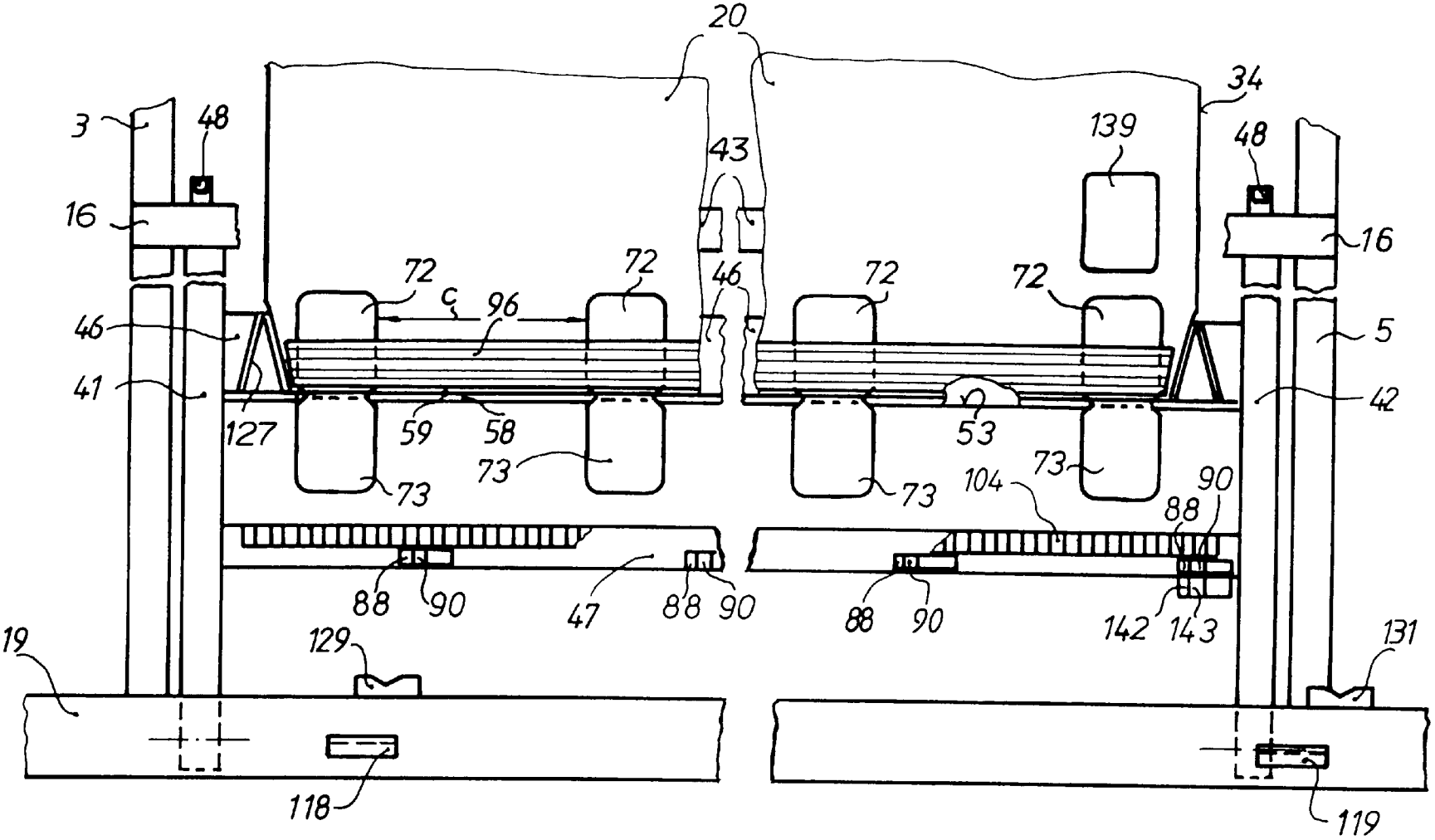

A frame 39, as depicted in FIG. 2, and which is pivotable over an angle alpha in respect to a perpendicular line 38 by means of a hinge 37, is disposed on the lower cross bar 17 extending in the axis-parallel direction in respect to the paper web feed roll 18. The frame 39 has two lateral supports 41, 42, which are shown in FIG. 3, and which in the working state extend perpendicularly and are connected by means of an upper and a lower cross bar 43, 44 with each other. Between the upper and lower cross bars 43, 44 and extending parallel with the cross bars 43, 44, the frame 39 also has a cutter cross bar 46 and a drive cross bar 47. These cross bars 46, 47 will be described in more detail further on. In its perpendicular working position the pivotable frame 39 can be locked in place by means of one or several pivotable bolts 48, which are arranged outside of the width "b" of the paper web feed roll 18 on the cross bar 16 of the frame 1, in that by means of a catch the bolt(s) 48 extend behind one or several angled holders 49 disposed on the upper cross bar 43. Rubber strips 51, 52 or strips of a similar elastic material are respectively arranged between the upper cross bar 43 of the pivotable frame 39 and the upper cross bar 16 of the frame 1 for clamping a paper web start 50 rolled off the paper web feed roll 18. The pivotable frame 39 therefore is also used in connection with the cross bar 16 as a holding device for the paper web start 50.

Figure 4:
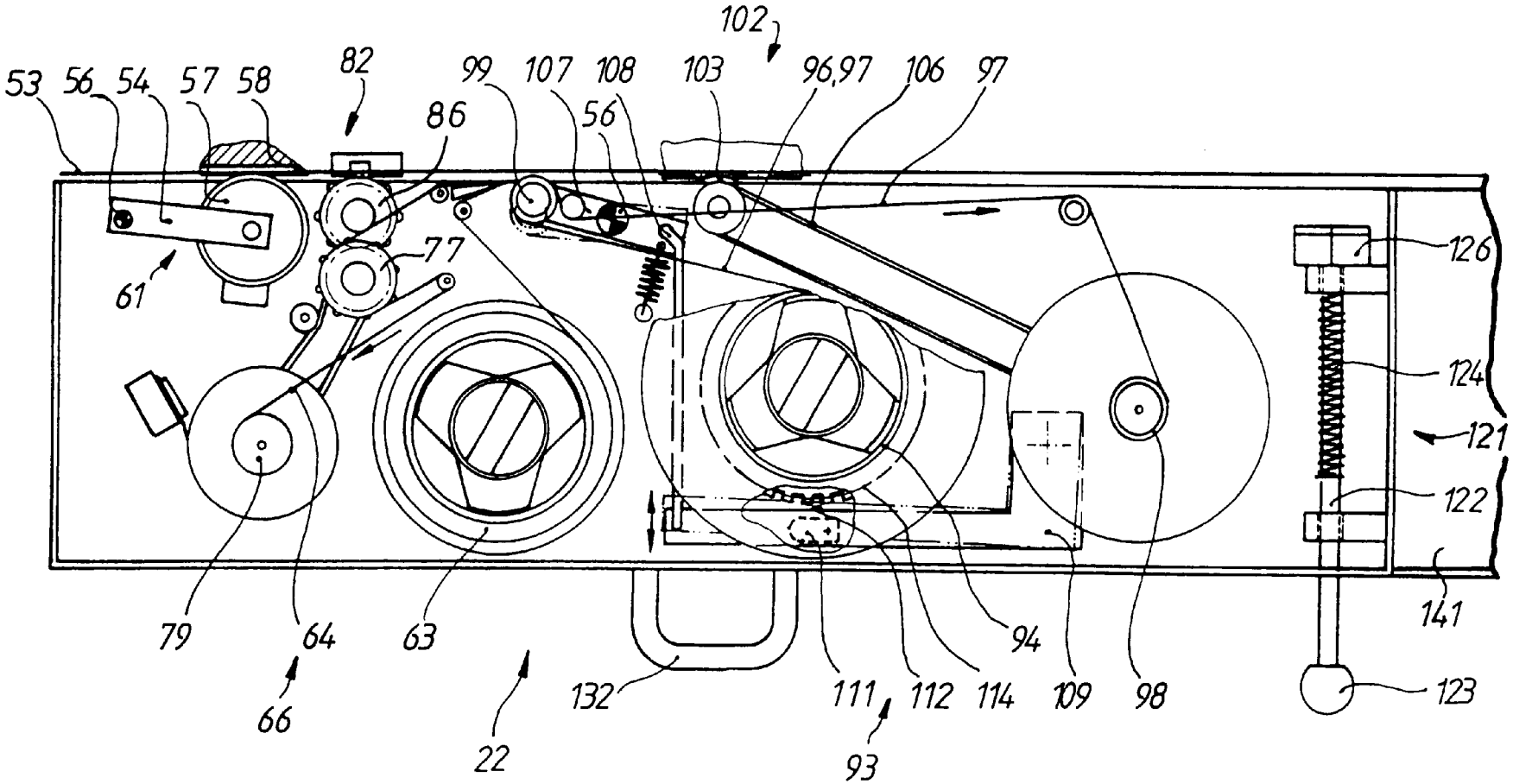

A circular cutter 57 for a transverse cutting device, identified by 61 as a whole, as may be seen in FIG. 4, is disposed on the work carriage 22—the latter essentially only shown in FIG. 2 in outline—which can be adjusted by means of the force of a spring, not shown, on a pivot arm 54 around a pivot shaft 56 fixed in place on the carriage, which cutter, when the work carriage 22 is displaced on the guide rail 19, engages a counter-cutting strip 45 with a cutting groove 58 maintained in a cutter cross bar 46 of the frame 39, and in the process transversely cuts the paper web start 50 and forms a start cut edge 53, so that it extends in an axis-parallel direction.

In another preferred embodiment, a transverse cutting device 62, not represented, can be constituted in that, in place of a cutting groove 58 in the cutter cross bar 46, a fixed cutting strip, extending over the entire width "b" of the paper web feed roll 18, is disposed, on whose cutting edge the paper web start 50 is pressed with a great force, for example by means of a pressure roller made of plastic.

Figure 6:
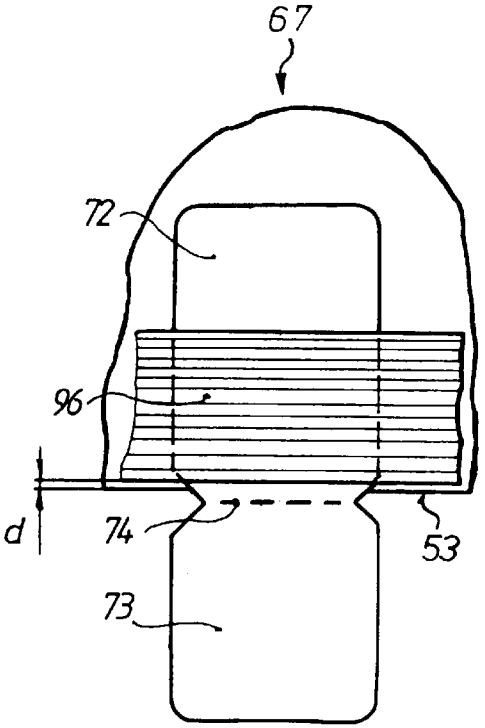
FIG. 6, a partial representation of an adhesive tab.
Figure 5:
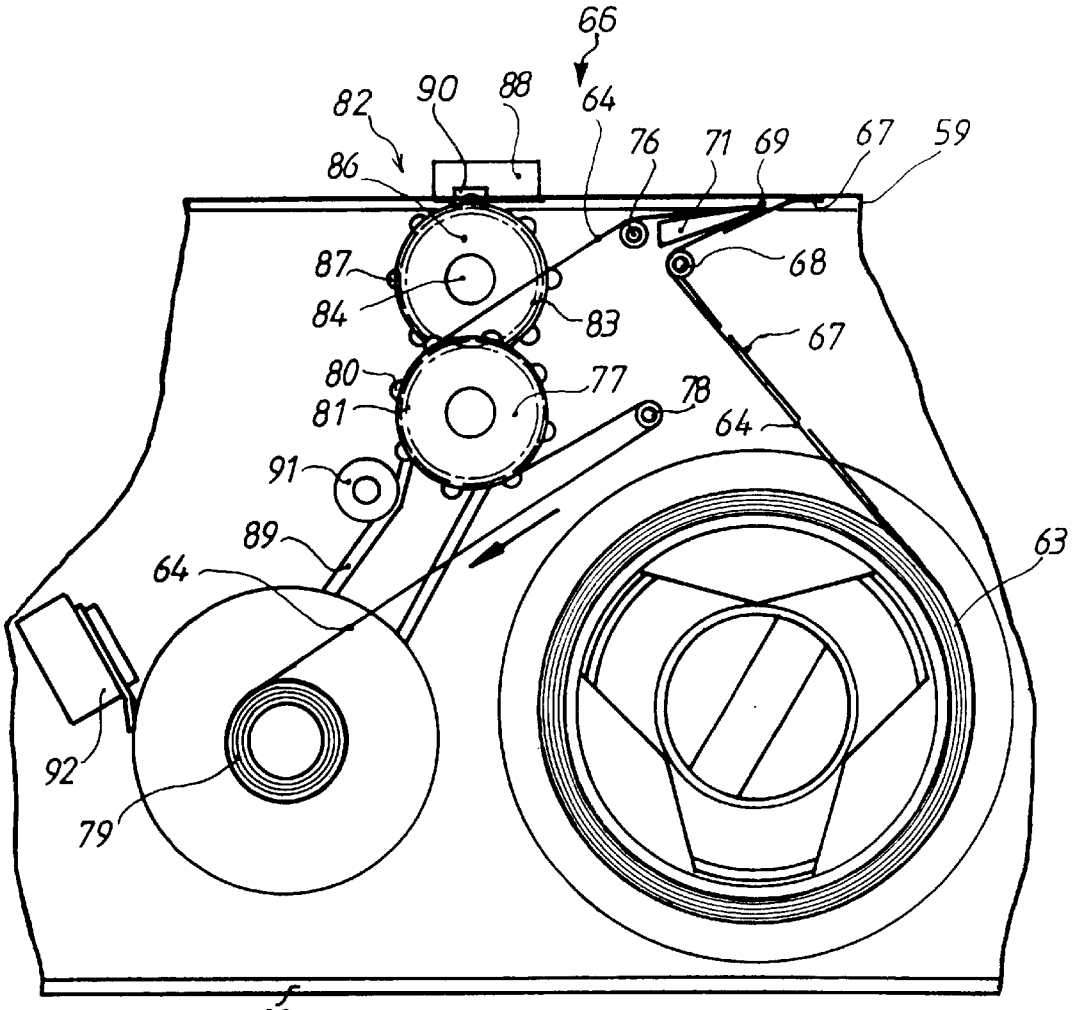

An adhesive tab dispenser, identified by 66 as a whole, and depicted in FIG. 4, is furthermore arranged on the work carriage and receives a supply roll 63 with a carrier tape 64 wound on it, which carries adhesive tabs 67 supplied with adhesive on one side, as shown in FIG. 5. The carrier tape 64 equipped with adhesive tabs 67 is conducted over a guide roller 68 and a release edge 69, located in close vicinity of the paper web start 50, of a tape guide 71 extending at an acute angle, in the course of which an adhesive tab 67 comes into adhesive contact with the paper web start 50 adjacent the cut edge 53, so that the adhesive surface of a first or top half 72 of the adhesive tab 67 sticks to the area of the paper web start 50 adjacent the cut edge 53, while a second or bottom half of the adhesive tab 67, which is ready to be stuck on, hangs over the paper web start cut edge 53, as is shown in FIG. 6. In this case a predetermined perforated tear line 74 has already been prepared between the upper half 72 and the lower half 73 of the adhesive tab 67. The carrier tape 64 is further conducted via guide rollers 76, 78 and a drawing roller 77 to a winding roller 79 for the carrier tape 64. The carrier tape 64 here has conveying holes along its lateral edges, which are engaged by driver pins 80 located on both ends of the drawing roller 77 on its circumference. The drawing roller 77 is furthermore provided on its one end with a gear wheel 81, which meshes with a gear wheel 83 of a driver unit, identified by 82 as a whole, and located near the pivot frame. The driver unit 82 consists of a gear wheel 83, seated fixed in place on the carriage, on whose shaft 84 a driver wheel 86 is interlockingly seated and which has a number of cams 87 on its circumference which, in turn, mesh with the driver 88 fixedly disposed on the drive cross bar 47 of the pivotable frame 39, when the work carriage 22 is moved. The drivers 88 have the same distance from each other as the adhesive tabs 67 and can have a perpendicular groove 90 in the center, which is engaged by a cam 87 of the driver wheel 86. The gear wheel 83 of the driver unit 82 meshes with the gear wheel 81 of the drawing roller 77, while a circular belt 89, which is seated on pulleys, rotates between the drawing roller 77 and the winding roller 79 and drives the winding roller 79 in turn. The circular belt 89 can be tightened by means of a tightening roller 91. The winding roller 79 can be provided with an elastic reversing safety 92 acting on the lateral disks of the winding roller 79.

In a further preferred embodiment for driving the adhesive tab dispenser 66 it is also possible, in place of the drawing roller 77, the driver wheel 86 and the circular belt drive 89, to provide the winding roller 64 with a separate electrical drive, not shown, for example an electric motor, which is switched on by means of a signal emitter, not shown, for example a limit switch, disposed on the work carriage 22 for applying an adhesive tab 67. After an adhesive tab 67 has been applied to the paper web 20, it is possible to scan the carrier tape 64 carrying the adhesive tab 67, viewed in its direction of running, ahead of the release edge 69 of the tape guide 71 by means of a photoelectric barrier or a microswitch disposed at a predetermined location on the work carriage 22 in order to switch off the drive of the winding roller 79 at the appearance of a new adhesive tab 67. The drive for the winding roller 79 is switched on again at the time the signal emitter, for example limit switch, fixed in place on the work carriage, comes into contact with a further triggering element fixed in place on the drive cross bar, for example a radial cam, not shown.

An adhesive tape dispenser or adhesive tape application device, identified by 93 as a whole, as also seen in FIG. 4, and which is also located on the work carriage 22, has an adhesive tape supply roller 94 for a double-sided adhesive tape 96, which is fixed in place on the carriage and is situated on a carrier tape 97, as well as a winding roller 98, also seated fixed in place on the carriage, for the carrier tape 97. The application of the adhesive tape 96 takes place by means of a spring-loaded pressure roller 99, which presses the adhesive tape 96 against the paper web start 50 and the latter against the cutter cross bar 46. In the course of the movement of the work carriage 22, the adhesive tape 96 is automatically pulled off the adhesive tape supply roller 94, which can be embodied so it can be braked, because of its adhesion to the paper web start 50, wherein the support tape 97 is wound up by means of a drive, identified by 102 as a whole and acting on the winding roller 98. This drive 102 for the winding roller 98 consists of a gear wheel 103, seated fixed in place on the work carriage, which engages a toothed rack 104, fixedly arranged on the drive cross bar 47 of the pivotable frame 39. A round belt 106, running over pulleys between the shaft of the gear wheel 103 and the shaft of the winding roller 98, makes the connection between the drive 102 and the winding roller 98 for the carrier tape 97.

The pressure roller 99 for the adhesive tape 96 is located on a first end of a double-armed lever 107, which is seated fixed in place on the work carriage and on whose second end a coupler 108 is connected with the first end of an elbow lever 109, whose second end is fixed in place on the carriage and rotatably seated. This lever mechanism 107, 108, 109 can be actuated by means of a cam 111 acting approximately on the center of the elbow lever 109. In this way it is possible to place the pressure roller 99 against the paper web 20 or move it away from it. Simultaneously with the pivoting away of the lever 107, the rotating movement of the adhesive tape supply roller 94 is stopped by means of the pressure roller 99 in that a locking pin 112, located in the vicinity of the cam 111 on the elbow lever 109, enters into a tooth gap of a gear wheel 114, which is fixedly connected with the shaft of the adhesive tape roller 94, as may be seen most clearly in FIG. 4.

Actuation of the cam 111 takes place via a perpendicularly disposed shaft 116, which is shown in FIG. 2, and on whose second end a lever extending at right angles to the shaft 116 is disposed and which, by means of a pin, respectively enters one of two control curves 118, 119 which, as seen in FIG. 3, a laterally disposed on the guide rail 19, in order to bring the lever 107 with the pressure roller 99 for the adhesive tape 96 in or out of contact. If, after the movement of the work carriage 22 has taken place, the lever 107 is switched off, the adhesive tape 96 is automatically torn off. The adhesive tape supply roller can also be placed on a driven roller support.

A corner cutting device 121 is also disposed on the work carriage 22, as seen in FIG. 4, and is used for cutting off the corners of the paper web start 50. This device consists of a plunger 122, seated fixed in place on the work carriage, which can be actuated against the force of a spring 124 from outside the housing of the work carriage 22 by means of a handle 123 in the radial direction of the paper web feed roll 18. In the process a V-shaped cutting edge 126 disposed at the end of the plunger 122 is pressed against a cutting groove 127 located in the cutter cross bar 46, so that the corners of a paper web start 50 are cut off a transversely cut paper web. In the course of the displacement of the work carriage 22, which for example has a so-called "ball catch" 128 on the underside of its housing as shown in FIG. 2, a ball seated in a housing against the force of a spring engages a depression of a counter-piece 129, 131, which is seated on the guide rail 19, in order to move in this way into one or the other cutting position of the displaceable work carriage 22 for cutting off the corners of the paper web start 50. In this way it is possible for the paper web start 50 to have different shapes, namely a straight, tailored paper web start 50 with or without corners extending axis-parallel with the paper web feed roll 18.

The movement or displacement of the work carriage 22 can take place manually by means of a handle 132 attached to the housing, or by means of a drive element, not shown, for example a motor-driven pinion acting against a toothed rack disposed on the guide rail 19. It would also be possible in the same way to actuate the pivotable frame 39 by means of a drive element, for example a cylinder-piston unit.

The mode of operation of the device in accordance with the present invention is as follows: the frame 1 is brought into a corresponding preparation position in respect to the paper web feed roll 18, i.e. it is displaced, for example, on the guide rails 32, 33 of the main carriage in the vertical direction, as seen in FIG. 1. The free end 50 of the paper web feed roll 18 is inserted between the rubber strips 51, 52 of the upper cross bar 43 of the pivotable frame 39 as well as the cross bar 16 which is fixed in place on the frame, and is subsequently conducted between the cutter cross bar 46 and the drive cross bar 47, so that the free end 50 of the paper web 20 at least covers the cutting groove 58 located in a counter-cutting strip. In the process the paper web feed roll 18 is turned. After clamping or fixing the paper web 20 between the rubber strips 51, 52 of the upper pivotable cross bar 43 or the cross bar 16 fixed in place on the frame, the work carriage 22 is moved or displaced from the right position, outside of the width "b" of the paper web feed roll 18, into a left position, also outside of the width "b" of the paper web feed roll 18, as is depicted in FIG. 1. In the process the following work steps are performed:

- transverse cutting of the paper web start 50 by means of the transverse cutting device 61, along the cutting groove 58, so that a cut edge 53 is created,
- application of adhesive tabs 67, placed at a distance "c" from each other, by means of a displaceable adhesive tab dispenser 66 in such a way that the respective adhesive surface of a first half 72 of each adhesive tab 67 is glued to the paper web start 50, while a second half 73 of each adhesive tab 67 projects past the paper web cut edge 53.
- application of double-sided adhesive tape 96 as the adhesive means for connective adhesion in the vicinity of the cut edge 53 and parallel or approximately parallel with it by means of a displaceable adhesive tape application device 93,
- cutting off the edges on both sides of the paper web start 50,
- following the release of the bolts 48 and pivoting away of the pivot frame 39, the paper web start 50 is wound back on the paper web feed roll 18 and in the process the lower halves 73 of the adhesive tabs 67 are pressed on the second layer of the paper web by means of the pressure roller 133, wherein the paper web feed roll 18 is turned, so that the respectively second halves 73 of the adhesive tabs 67 rest with their adhesive surface on the second layer of the paper web feed roll 18.

It is also possible to apply the adhesive application 96, which extends parallel with the paper web start cut edge 53, directly following the application of the adhesive tabs 67, or selectively only after a further turn of the paper web feed roll 18.

Pressing is performed by means of the pressure roller 133 which is shown in FIG. 1, and which is supported in pivotable arms 134, 136 that can be placed on both sides pivotably and by means of tension springs 137, 138 against the guide rails 32, 33 at the ends of the struts 7, 11 facing away from the main carriage. The pressure roller 133 has a cover of a plastic material with anti-adhesive properties, for example a cover of silicon caoutchouc. Anti-adhesive properties are understood to be properties of the plastic material which reject an adhesive. It is also possible to employ a brush roller in place of a pressure roller 133, whose bristles are made of a plastic material with anti-adhesive properties, so that here, too, the adhesion on the top of the double-sidedly acting adhesive tape 96 is made impossible.

In accordance with a further preferred embodiment it is possible to arrange a second tab dispensing device 141 on the work carriage 22, which has a function analogous to that of the first adhesive tab dispensing device 66 which is shown in FIGS. 4 and 5. The second tab dispensing device 141 is arranged at the end of the work carriage 22 on the side of the corner cutting device 121 remote from the adhesive tab dispenser. The tab dispensing device 141 is used, for example, for dispensing reflecting foil tabs 139, seen in FIG. 3, which are respectively applied once on the paper web 20 in the vicinity of the cut edge 53. At the time of delivery of a paper web roll 18, such a tab 139 applied to the start of the paper web 20 can be used, in connection with a signal emitter, not represented, for selecting the correct moment for connecting the paper web feed roll 18 with a paper web roll which is running out. The foil tab 139 can be disposed in the vicinity of a first lateral edge 34 of the paper web 20 as well as simultaneously in the vicinity of the upper part 72 of an adhesive tab 67. In the process the movement of the tab dispensing device 141 is triggered by the engagement of a cam, analogous to the cam 87, of a driver wheel, analogous to the driver wheel 86, in a groove 143 of a driver 142 shown in FIG. 3 and located on the drive cross bar 47 analogous to the first adhesive tab dispensing device 66.

In accordance with another preferred embodiment, the holding device 39; 43, 51; 52, 16 can also consist of a holding strip, which is fixed in place on the frame and which is charged with a vacuum. For example, in place of the arrangement of a pivotable frame 39, it is possible to equip the cross bar 16 fixed in place on the frame with suction cups for holding the paper web 20 depicted in FIG. 2, wherein the suction air supply can be provided through the hollow profile of the cross bar 16.

It would furthermore be possible to employ a known holding strip based on the principles of electrostatic effects for holding the paper web 20, instead of the holding strip which can be charged with a vacuum.

In accordance with the present invention it is also possible, following the cutting of the paper web 20 along the cutting groove 58 in an axis-parallel direction by means of the transverse cutting device 61, to first apply double-sided adhesive tape 96 by means of the adhesive tape dispenser 93, and only later to apply the adhesive tabs 67, which are to be placed next to each other at a distance "c", by means of the also displaceable adhesive tab dispensing device 66. This means that the top adhesive layer, intended for connecting the paper webs, of the adhesive tape 96 is respectively covered at the distance "c" by the first part 72 of the adhesive tab 67. With an adhesive force of the upper adhesive layer of the adhesive tape which respectively is of sufficient strength, no problems can occur during the paper web connection.

By means of the method in accordance with the present invention and the common arrangement on the displaceable carriage 22 of the transverse cutting device 61, the tab dispensing device 66 and the adhesive tape dispensing device 93, it is possible to execute the said method steps in the following sequence:

a) Transverse cutting of the paper web 20 as well as the application of the adhesive tabs 67 in the course of a linear, axis-parallel advancing movement of the work carriage 22, applying the double-sided adhesive tape 96 by means of a linear, axis-parallel retrograde movement of the work carriage 22;

b) Transverse cutting of the paper web 20 as well as the application of the double-sided adhesive tape 96 in the course of a linear, axis-parallel advancing movement of the work carriage 22, application of the adhesive tabs 67 by means of a linear, axis-parallel retrograde movement of the work carriage 22;

c) Transverse cutting of the paper web 20 in the course of a first linear, axis-parallel advancing movement of the work carriage 22, application of the adhesive tabs 67 in the course of a linear, axis-parallel retrograde movement of the work carriage 22, application of the double-sided adhesive tape 96 by means of a second linear, axis-parallel advancing movement of the work carriage 22;

d) Transverse cutting of the paper web 20, application of the adhesive tabs 67 as well as the application of the double-sided adhesive tape 96 by means of a linear, axis-parallel movement.

The double-sided adhesive tape 96 is advantageously applied at the start 50 of the paper web 20, i.e. beginning directly at the cut edge 53, or at a selectable distance "d", for example between one and two millimeters, as is depicted in FIG. 6. The adhesive tape 96 can be made of a support material tape 96, for example, which has been provided on both sides with an adhesive layer. It is furthermore possible to equip the adhesive tape dispensing device 93 disposed on the work carriage 22 with clocked spray nozzles in place of the adhesive tape dispensing mechanism, which apply a sprayable adhesive on the paper web 20. The solvent of such a known sprayable adhesive evaporates after application to the paper web 20 and it subsequently stays adhesive for a predeterminable length of time, for example one or two days.

It is possible here to embody the shape of the adhesive applied by spraying to be in strips, wavy lines or zig-zagged. While a method and a device for preparing the beginning of a paper web feed roll for changing rolls in motion, in accordance with the present invention has been set forth fully and completely hereinabove, it will be apparent to one of skill in the art that a number of changes in, for example, the size of the paper web roll, the type of press it is to be used with, the composition of the adhesive and the like can be made without departing from the true spirit and scope of the present invention which is accordingly to be limited to the following claims.

I claim:

1. A method for producing a start of a paper web feed roll and for preparing said start of said paper web feed roll for a flying roll change including:

providing a paper web feed roll and supporting said feed roll on a shaft for rotation about a paper web feed roll rotational axis;

providing a holding device for holding a free end of said paper web;

providing a work carriage and supporting said work carriage for movement parallel to said rotational axis of said paper feed roll:

providing a displaceable transverse cutting device having a cutting groove located in a counter cutting strip;

locating said transverse cutting device on said work carriage:

securing said free end of said paper web in said holding device and cutting said free end, by using said transverse cutting device, along said cutting groove in a direction parallel to said paper web roll rotational axis and forming a cut edge and an adjacent paper web start;

providing a displaceable adhesive tab application device having one sidedly glued adhesive tabs for fastening said paper web start to a second layer of said paper web feed roll;

locating said adhesive tab application device on said work carriage:

applying first parts of said adhesive tabs to said paper web start, spaced apart from each other along said start, in a direction parallel to said paper web roll rotational axis across an entire width of said paper web roll by using said adhesive tab application device with second parts of each of said adhesive tabs extending past said cut edge of said paper web start;

providing a displaceable adhesive tape application device having a double sided adhesive tape;

locating said adhesive tape application device on said work carriage:

applying said double sided adhesive tape to said paper web start adjacent said cut edge and approximately parallel to said cut edge;

cutting said free end, applying said first parts of said adhesive tabs, and applying said double sided adhesive tape all during movement of said work carriage:

releasing said paper start from said holding device after said cutting of said free end, and after application of said adhesive tabs and said adhesive tape to said paper start; and winding said start of said paper web back on said paper web feed roll and pressing said second parts of said adhesive tabs on said second layer of said paper web feed roll.

2. The method of claim 1 including performing said transverse cutting and said application of said tabs during movement of said work carriage in a first direction and application of said tape during movement of said work carriage in a second direction.

3. The method of claim 1 including performing said transverse cutting and said application of said adhesive tape during movement of said work carriage in a first direction and application of said adhesive tabs during movement of said work carriage in a second direction.

4. The method of claim 1 including performing said transverse cutting during a first movement of said work carriage in a first direction, applying said adhesive tabs during a movement of said work carriage in a second direction, and applying said adhesive tape during a second movement of said work carriage in said first direction.

5. The method of claim 1 including performing said transverse cutting, said application of said adhesive tabs and said application of said adhesive tape during movement of said work carriage in said first direction.

6. The method of claim 1 further including providing said adhesive tape as a support material tape having an adhesive layer on both sides thereof.

7. The method of claim 1 further including providing said adhesive tape as a spray adhesive and applying said spray adhesive to said paper web in a liquid state.

8. The method of claim 1 further including providing a foil tab application device and applying a foil tab to said paper web start adjacent a first lateral edge of said paper web.

9. A device for producing a start of a paper web feed roll and for preparing said start of said paper web feed roll for a flying roll change comprising:

a paper web feed roll support for supporting said paper web feed roll for rotation about a paper web feed roll rotational axis;

a holding device for holding a free end of said paper web;

a work carriage;

a frame to support said work carriage for movement of said work carriage with respect to said support parallel to said paper web feed roll rotational axis; and a transverse cutting device, an adhesive tab dispensing device, and an adhesive tape dispensing device all carried by said work carriage, said transverse cutting device being usable to cut a leading edge in said paper web free end and to form a paper web start, said adhesive tab dispensing device carried on said work carriage being usable to apply adhesive tabs to said paper web start, said adhesive tape dispensing device carried on said work carriage being usable to apply adhesive tape to said paper web start adjacent said leading edge.

10. The device in accordance with claim 9 further including a foil tab dispensing device carried on said work carriage.

11. The device of claim 9 wherein said frame includes a guide rail for receiving said work carriage, said guide rail extending in a direction parallel to said paper web feed roll rotational axis.

12. The device of claim 9 wherein said paper web feed roll support is a roll changer having side frames and further wherein said frame is a main carriage which is supported for movement in a vertical direction on said side frames.

13. The device of claim 9 wherein said frame is a displaceable frame which can be moved between a plurality of said paper web feed roll supports.

14. The device of claim 9 wherein said transverse cutting device includes a circular cutter and further wherein a cutter cross bar having a horizontal cutting groove is secured to said frame and cooperates with said circular cutter.

15. The device of claim 14 further including pressure rollers secured on said work carriage and engaging said cutter cross bar.

16. The device of claim 9 wherein said adhesive tab dispensing device includes a supply roll of said adhesive tabs supported on a carrier tape, and a driven winding roller for said carriage tape and further including a release edge, said carrier tape passing over said release edge and said adhesive tabs being transferred to said paper web start, said release edge forming an acute angle around which said carrier tape moves.

17. The device of claim 16 further including a driver unit for said supply roll of said adhesive tabs, said driver unit including cams, and a drive cross bar secured on said frame, said drive cross bar having drivers which are engaged by said driver unit cams.

18. The device of claim 16 including a driver unit for said supply roll of said adhesive tabs, said driver unit having a first gear wheel and further including a drawing roller for said carrier tape, said drawing roller having a second gear wheel in engagement with said first gear wheel, and a belt drive, said belt drive connecting said drawing roller and said winding roller for said carrier tape.

19. The device of claim 9 further including an electric drive motor for said adhesive tab dispensing device, and a signal emitter secured on said work carriage and usable to control said electric motor, and further including an adhesive tab scanning device on said work carriage.

20. The device in accordance with claim 9 wherein said holding device includes a pivotable frame having an upper cross bar, and a fixed cross bar secured to said frame, said upper cross bar and said fixed cross bar forming a clamping place for said paper web.

21. The device of claim 20 further including a rubber strip secured to a facing side of one of said upper cross bar and said fixed cross bar.

22. The device of claim 9 wherein said holding device includes a holding strip secured to said frame, and means to supply a vacuum to said holding strip.

23. The device of claim 9 wherein said holding device includes a holding strip and means to electrostatically charge said holding strip.

24. The device of claim 9 further including a paper web corner cutting device disposed on said work carriage.

* * * * *